US007595590B2

(12) United States Patent
Jeong

(10) Patent No.: US 7,595,590 B2
(45) Date of Patent: Sep. 29, 2009

(54) PLASMA DISPLAY APPARATUS

(75) Inventor: Kwang-Jin Jeong, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 476 days.

(21) Appl. No.: 11/365,925

(22) Filed: Mar. 2, 2006

(65) Prior Publication Data

US 2006/0220995 A1 Oct. 5, 2006

(30) Foreign Application Priority Data

Apr. 4, 2005 (KR) ..... 10-2005-0028085

(51) Int. Cl.
*H01J 17/49* (2006.01)

(52) U.S. Cl. ..... 313/582; 345/60

(58) Field of Classification Search ..... 313/582–587; 315/169.1, 169.3; 345/60, 75.2
See application file for complete search history.

(56) References Cited

U.S. PATENT DOCUMENTS 5,959,620 A * 9/1999 Oura et al. ..... 345/204

FOREIGN PATENT DOCUMENTS

| | | |
|---|---|---|
| JP | 08-30211 | 2/1996 |
| JP | 2003-062268 | 3/2003 |
| JP | 2004-069888 | 3/2004 |

OTHER PUBLICATIONS

English translation of JP 2003-062268 A, Sekine et al.*
English translation of JP 2004-069888 A, Sato et al.*
Japanese Office action for Japanese patent application No. 2005-298859 issued on Mar. 4, 2008.
Korean Office action for Korean patent application No. 2005-0028085 issued on Aug. 24, 2006.

* cited by examiner

*Primary Examiner*—Nimeshkumar D. Patel
*Assistant Examiner*—Mary Ellen Bowman
(74) *Attorney, Agent, or Firm*—Robert E. Bushnell, Esq.

(57) ABSTRACT

A plasma display apparatus includes a plasma display panel including a display area where an image is displayed and an auxiliary display member surrounding the display area of the plasma display panel. The auxiliary display member causes a user to think that he/she is seeing a screen that appears larger than it really is.

9 Claims, 5 Drawing Sheets

PLASMA DISPLAY APPARATUS

CLAIM OF PRIORITY

This application makes reference to, incorporates the same herein, and claims all benefits accruing under 35 U.S.C. § 119 from an application for PLASMA DISPLAY APPARATUS earlier filed in the Korean Intellectual Property Office on 4 Apr. 2005 and there duly assigned Serial No. 10-2005-0028085.

BACKGROUND OF THE INVENTION

1. Field of the Invention

The present invention relates to a plasma display apparatus, and more particularly, to a plasma display panel for displaying an image so that a user can think that he/she is watching a screen larger than it really is.

2. Description of the Related Art

Plasma display apparatuses are flat panel displays displaying an image using a gas discharge, and are considered to be the next generation of flat panel displays due to high display properties such as display capacity, brightness, contrast, image sticking, and viewing angle.

In general, the plasma display apparatus includes a plasma display panel, a chassis substantially parallel to the plasma display panel, a circuit unit disposed on a rear portion of the chassis to drive the plasma display panel, and a case accommodating the plasma display panel, the chassis, and the circuit unit.

However, since size of the plasma display apparatus increases, the price of the apparatus greatly increases, and thus, consumers may not afford to buy the apparatus of desired size. When the size of the plasma display apparatus increases, the fabrication costs increase more.

Therefore, the plasma display apparatus, fabrication costs of which less increases, and by which a user can feel enlarged screen, is required.

SUMMARY OF THE INVENTION

The present invention provides a plasma display apparatus having an auxiliary display member which causes a user to think that he/she is seeing a screen that appears larger than it really is.

According to one aspect of the present invention, a plasma display apparatus is provided including: a plasma display panel including a display area adapted to display an image; and an auxiliary display member surrounding the display area of the plasma display panel.

The auxiliary display member is preferably adapted to display an image using a plurality of Light Emitting Diodes (LEDs). The auxiliary display member is preferably adapted to display an image corresponding to the image displayed on an edge of the display area. The auxiliary display member preferably includes unit pixels adapted to display an average of images displayed by a predetermined number of pixels disposed along an edge of the display area.

According to another aspect of the present invention, a plasma display apparatus is provided including: a plasma display panel including a display area adapted to display an image; an auxiliary display member surrounding the display area of the plasma display panel; and a chassis including a front surface attached to the plasma display panel and a rear surface including a circuit unit having circuits adapted to drive the plasma display panel contained therein.

The apparatus preferably further includes a front case including a window adapted to enable the image displayed on the display area to be viewed and a rear case attached to the front case to define an inner space containing the plasma display panel.

The auxiliary display member is preferably disposed between the front case and the plasma display panel.

The auxiliary display member is preferably adapted to display an image using a plurality of Light Emitting Diodes (LEDs). The auxiliary display member is preferably adapted to display an image corresponding to the image displayed on an edge of the display area. The auxiliary display member preferably includes unit pixels adapted to display an average of images displayed by a predetermined number of pixels disposed along an edge of the display area.

A portion of the front case corresponding to the auxiliary display member preferably includes a translucent material.

BRIEF DESCRIPTION OF THE DRAWINGS

A more complete appreciation of the present invention and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
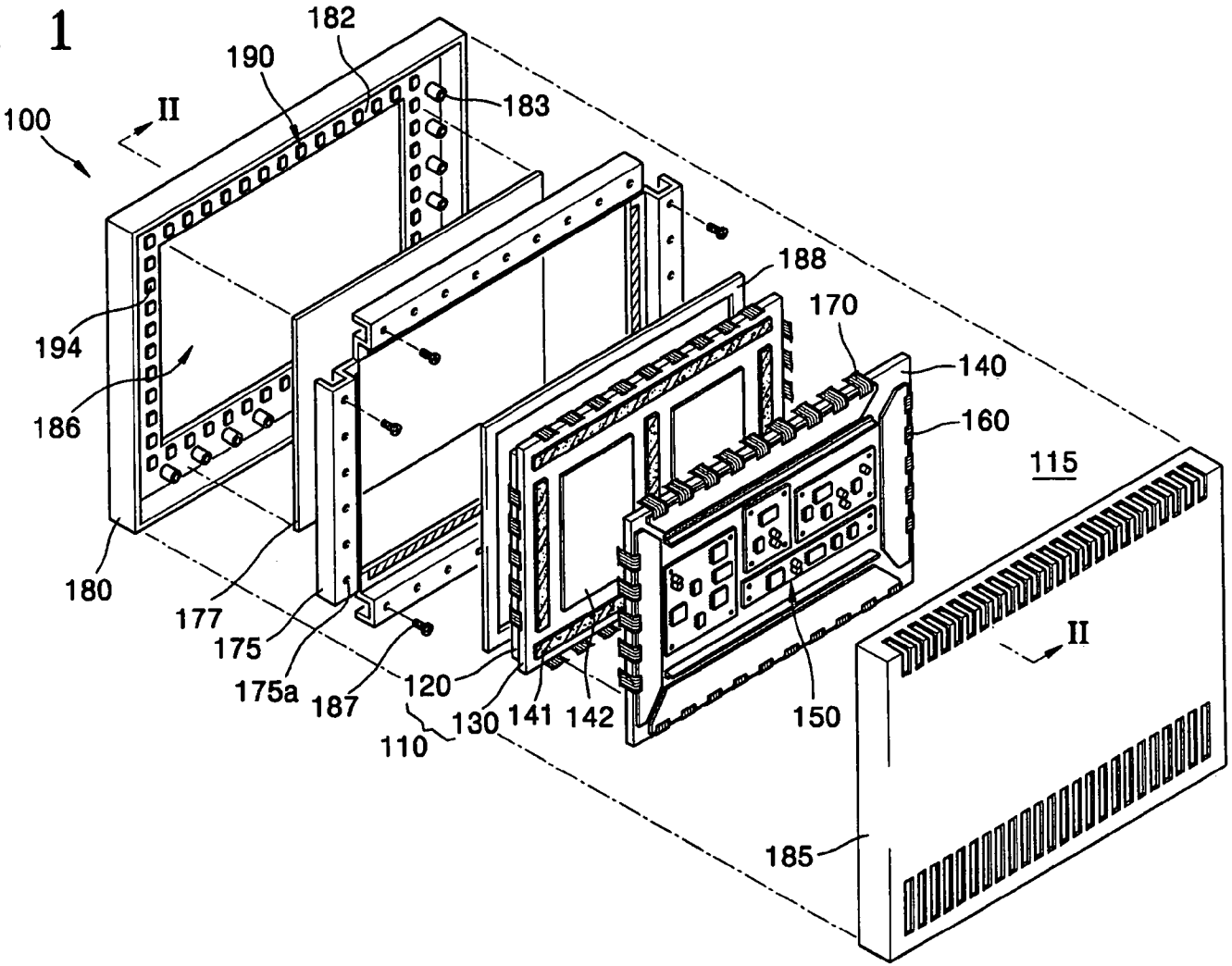
FIG. 1 is an exploded perspective view of a plasma display apparatus according to an embodiment of the present invention.
Figure 2:
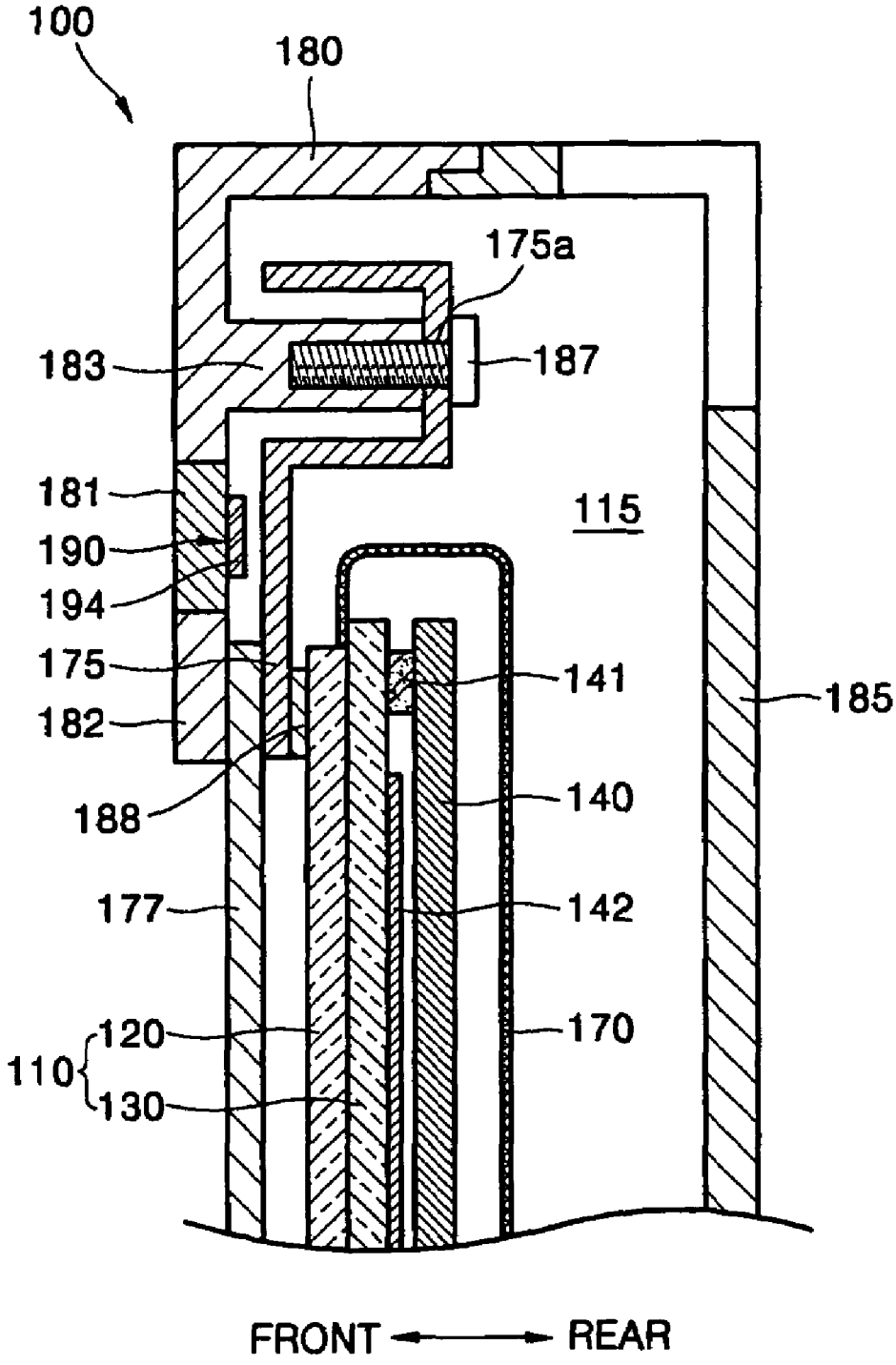
FIG. 2 is a cross-sectional view of the plasma display apparatus taken along line II-II of FIG. 1.

FIG. 1 is an exploded perspective view of a plasma display apparatus 100 according to an embodiment of the present invention, and FIG. 2 is a cross-sectional view of the plasma display apparatus 100 taken along line II-II of FIG. 1. Referring to the drawings, the plasma display apparatus 100 includes a front case 180, a rear case 185, a plasma display panel 10, a chassis 140, a circuit unit 150, and an auxiliary display member 190.

The front case 180 includes a window 186, to which an image realized by the plasma display panel 110 is projected, formed on a center portion thereof and surrounded by a peripheral portion 182. The rear case 185 is attached to the front case 180 to define a space 115, in which the plasma display panel 110, the chassis 140, and the circuit unit 150 are disposed.

A filter 177 is disposed on a rear portion of the front case 180 to cover the window 186. In addition, the filter 177 shields electromagnetic waves generated by the plasma display panel 110 and the circuit unit 150, and protects the plasma display panel 110. It is preferable for the filter 177 to be formed of a material including a glass. The filter 177 is attached to the peripheral portion 182 of the front case 180 by a filter holder 175. That is, coupling bosses 183 are formed on the peripheral portion 182 of the front case 180, and the coupling bosses 183 are coupled to screws 187 inserted into penetration holes 175*a* of the filter holder 175. The filter 177 is disposed between the filter holder 175 and the front case 180, and thus, the filter 177 is fixedly pressed onto the peripheral portion 182 of the front case 180 by the above coupling structure.

In addition, a buffer member 188 is disposed between the plasma display panel 110 and the filter holder 175 to prevent the plasma display panel 110 from being damaged due to direct contact with the filter holder 175.

Figure 3:
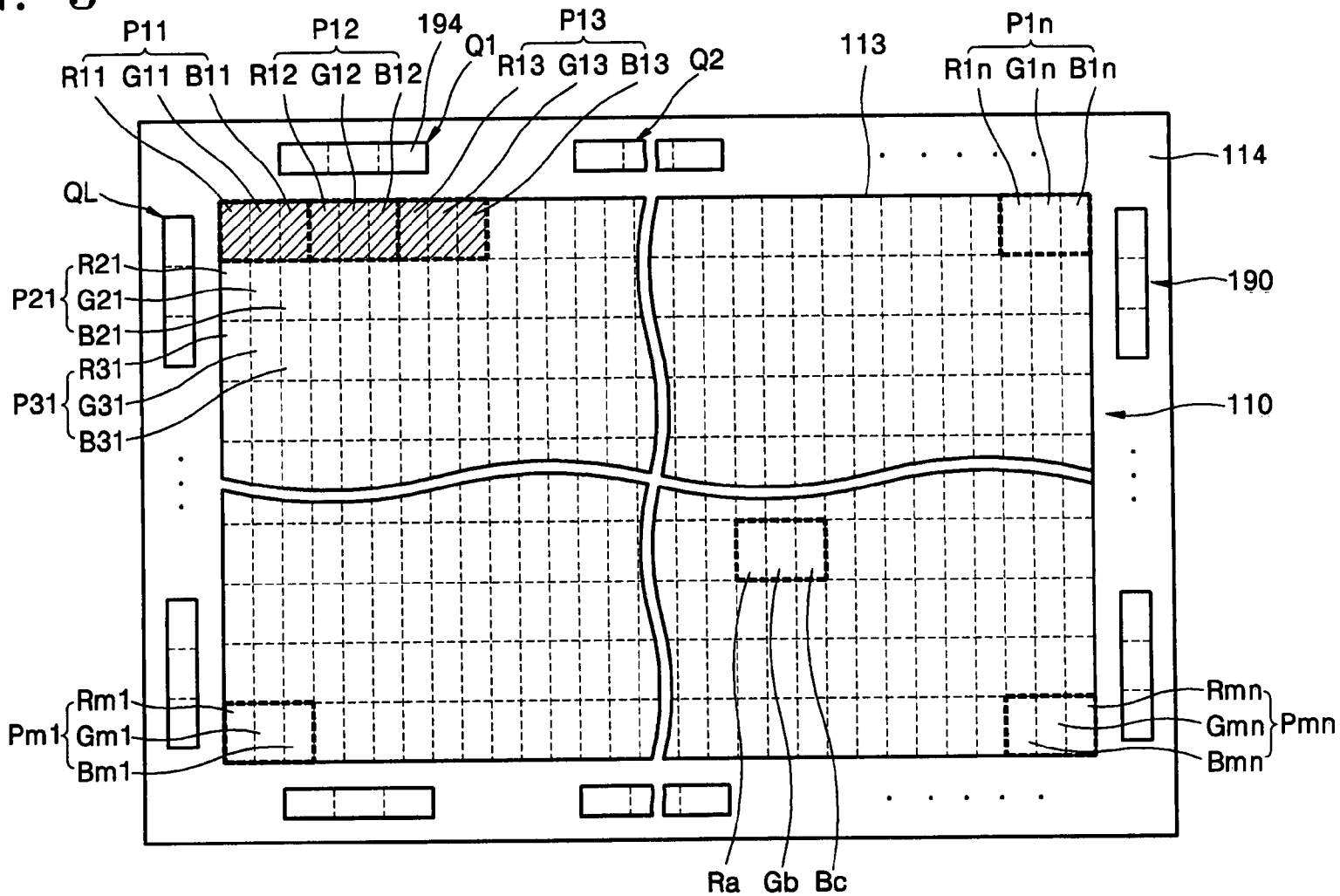
FIG. 3 is a plan view of pixels in the plasma display panel of FIG. 1 and pixels of an auxiliary display member.

The plasma display panel 110 is disposed on a rear portion of the filter holder 175, and the plasma display panel 110 displays an image using a gas discharge. FIG. 3 is a plan view of arrangements of pixels in the plasma display panel 110 and pixels in the auxiliary display member 190 shown in FIG. 1. Referring to FIG. 3, the plasma display panel 110 includes a display area 113 disposed on a center portion of the panel 110 and displaying a substantial image, and a non-display area 114 surrounding the display area 113 and including terminal portions (not shown). The image generated on the display area 113 of the plasma display panel 110 exits through the window 186 of the front case 180, and the display area 113 includes a plurality of pixels P11, P12, . . . , Pmn. In addition, each of the pixels P11, P12, . . . , Pmn includes a red sub-pixel (R), a green sub-pixel (G), and a blue sub-pixel (B). For example, the pixel P11 includes the red sub-pixel R11, the green sub-pixel G11, and the blue sub-pixel B11, and the pixel Pmn includes the red sub-pixel Rmn, the green sub-pixel Gmn, and the blue sub-pixel Bmn.

Figure 4:
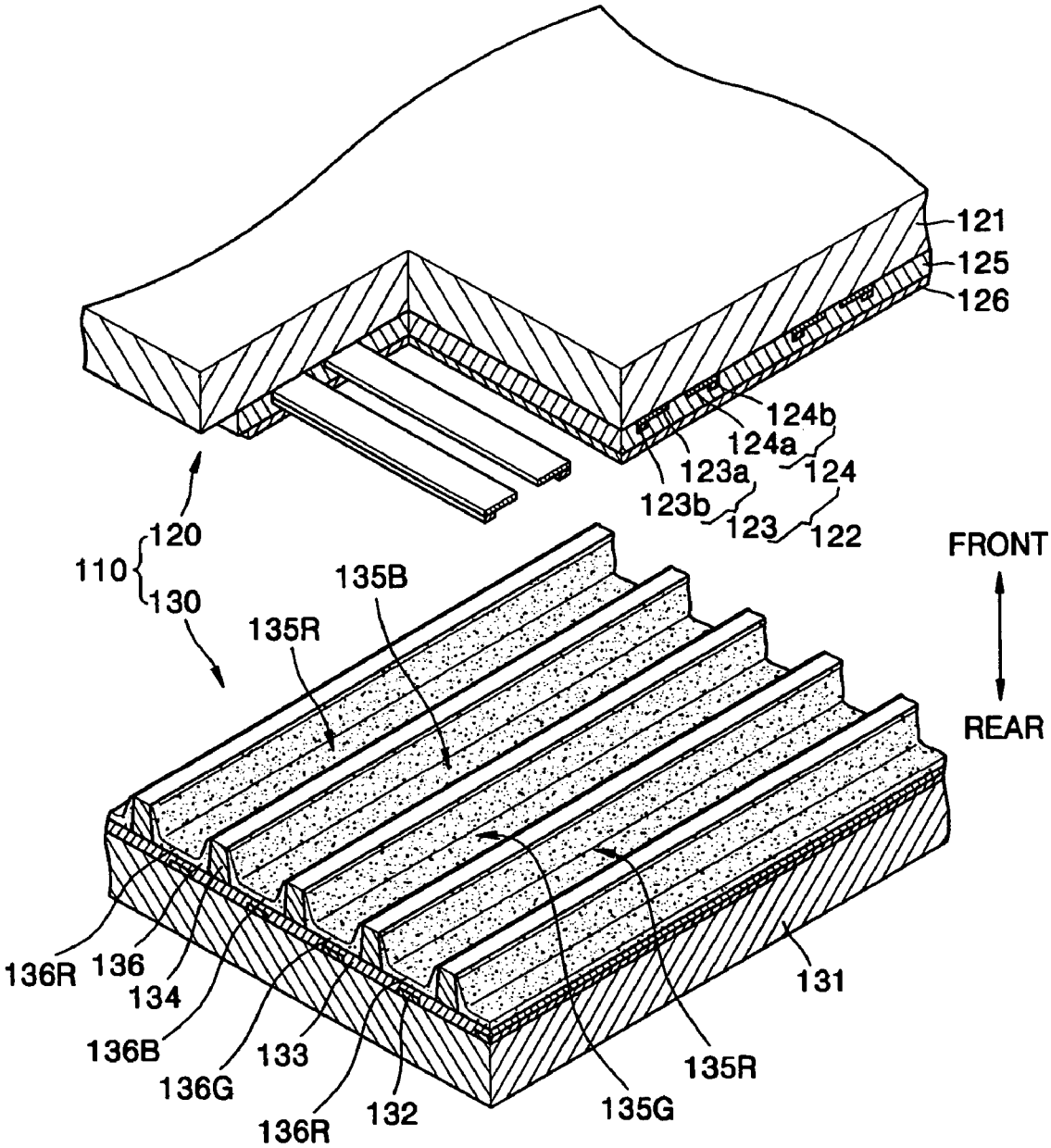
FIG. 4 is a partial exploded perspective view of an example of the plasma display panel of FIG. 1.

Various kinds of plasma display panels can be used as the plasma display panel 110, for example, an Alternating Current (AC) plasma display panel having a surface-discharge three-electrode structure can be used as shown in FIG. 4.

Referring to FIG. 4, the plasma display panel 110 includes a front panel 120, and a rear panel 130 coupled to the front panel 120. The front panel 120 includes a front substrate 121, sustain electrode pairs 122 formed on a rear surface of the front substrate 121, each of the pairs including an X electrode 123 and a Y electrode 124, a front dielectric layer 125 covering the sustain electrode pairs 122, and a protective layer 126 formed on a rear surface of the front dielectric layer 125. The X electrode 123 and the Y electrode 124 perform as a common electrode and a scan electrode respectively, and are separated from each other by a discharge gap. In addition, the X electrode 123 includes an X transparent electrode 123*a* and an X bus electrode 123*b* connected to the X transparent electrode 123*a*, and the Y electrode 124 includes a Y transparent electrode 124*a* and a Y bus electrode 124*b* connected to the Y transparent electrode 124*a*.

The rear panel 130 includes a rear substrate 131, address electrodes 132 formed on a front surface of the rear substrate 131 and extending in a direction of crossing the sustain electrode pairs 122, a rear dielectric layer 133 covering the address electrodes 132, barrier ribs 134 formed on the rear dielectric layer 133 to define red, green, and blue discharge cells 135R, 135G, and 135B, phosphor layers 136R, 136G, and 136B disposed in the discharge cells 135R, 135G, and 135B, and a discharge gas filled in the discharge cells 135R, 135G, and 135B. The red discharge cell 135R corresponds to the red sub-pixel Ra and includes the red phosphor layer 136R, the green discharge cell 135G corresponds to the green sub-pixel Gb and includes the green phosphor layer 136G, and the blue discharge cell 135B corresponds to the blue sub-pixel Bc and includes the blue phosphor layer 136B.

Referring to FIGS. 1 through 3, the auxiliary display member 190 is disposed between the front case 180 and the filter holder 175. The auxiliary display member 190 is fixed on a rear surface of the front case 180, and surrounds the window 186 of the front case 180. Therefore, the auxiliary display member 190 surrounds the display area 113 of the plasma display panel 110, and displays an image surrounding the display area 113. It is preferable for a portion 181 of the front case 180 where the auxiliary display member 190 is disposed to be formed of a translucent material, and thus, the image generated by the auxiliary display member 190 can be projected frontward. In addition, since the auxiliary display member 190 is visible to the user when the portion 181 of the front case 180 is formed of the transparent material, degradation of appearance can be prevented when the auxiliary display member 190 is formed of the translucent material. Various image display apparatuses can be used in the auxiliary display member 190, Preferably, Light Emitting Diodes (LEDs) 194 can be used in the auxiliary display member 190. In the present embodiment, the auxiliary display member 190 includes a plurality of pixels, and each of the pixels includes red, green, and blue LEDs 194. In addition, the pixels of the auxiliary display member 190 are arranged in an order of a first pixel Q1 , a second pixel Q2, . . . , a Lth pixel QL from upper left portion of the display area 113 in a clockwise direction.

The chassis 140 that can be formed using a casting or a pressing process. The chassis 140 supports the plasma display panel 110 and the circuit unit 150. The chassis 140 can be formed of a metal having a high thermal conductivity, such as aluminum, in order to dissipate the heat transmitted from the plasma display panel 110. The plasma display panel 110 and the chassis 140 are attached to each other using a dual-adhesive tape 141.

A thermal conductive sheet 142 is disposed between the plasma display panel 110 and the chassis 140 to diffuse the heat generated locally on the plasma display panel 110 and transmit some of the heat generated from the plasma display panel 110 to the chassis 140. The thermal conductive sheet 142 can be a silicon glass, a silicon heat dissipation sheet, an acryl-based heat dissipation and pressure reduction adhesive sheet, a urethane-based heat dissipation and pressure reduction adhesive sheet, or a carbon sheet.

Figure 5:
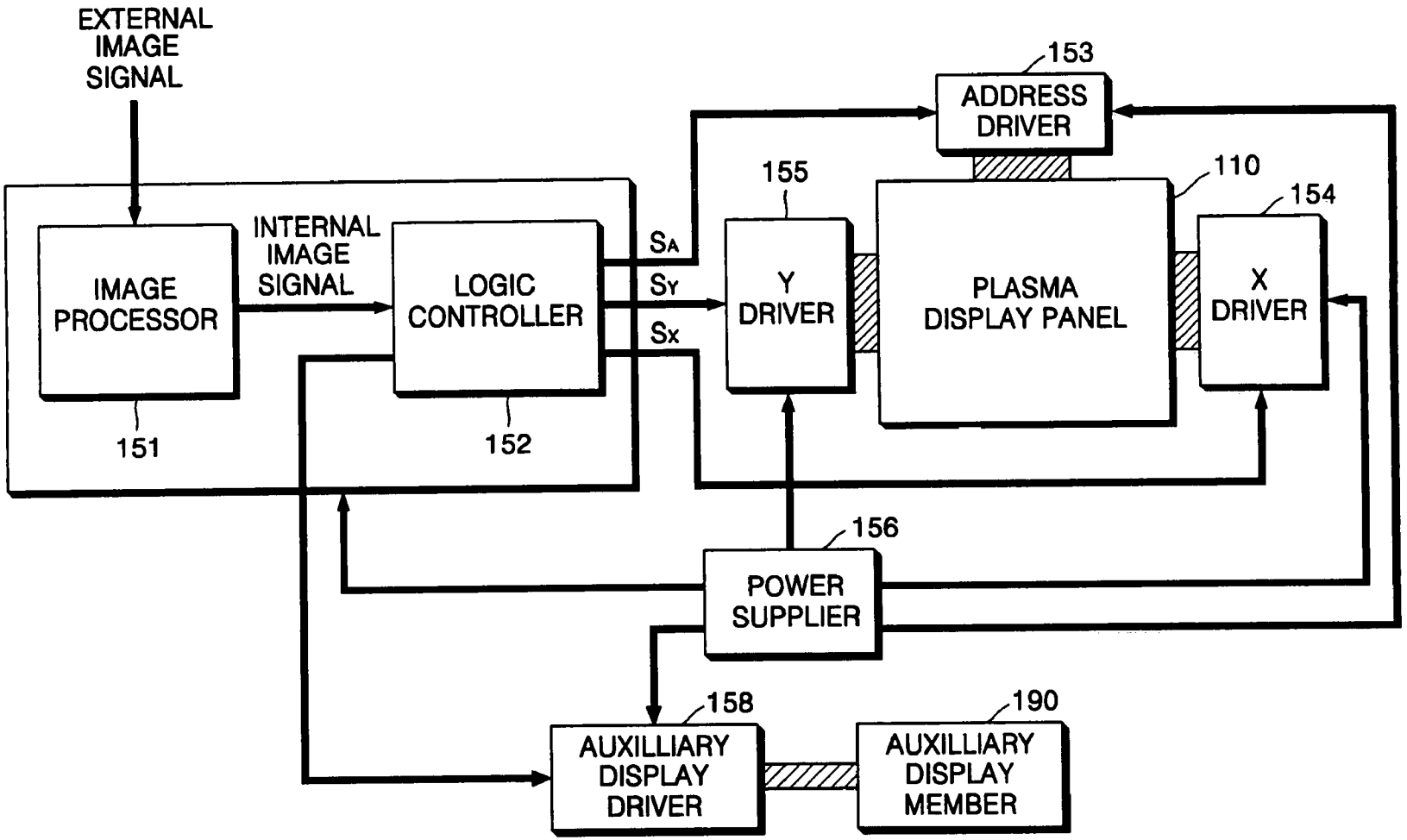
FIG. 5 is a block diagram illustrating operations of a circuit unit of FIG. 1.

The circuit unit 150 is disposed on a rear portion of the chassis 140, and the circuit unit 150 includes a plurality of circuit wires and a plurality of various electronic elements connected to the circuit wires. The circuit unit 150 drives the plasma display panel 110. Referring to FIG. 5, the circuit unit 150 includes an image processor 151, a logic controller 152, an address driver 153, an X driver 154, a Y driver 155, an auxiliary display driver 158, and a power supplier 156. The image processor 151 converts an external analog image signal into a digital signal to generate internal image signals, for example, red, green, and blue image data, a clock signal, and vertical and horizontal synchronization signals of 8 bits, respectively.

The logic controller 152 generate driving control signals SA, SY, and SX for the plasma display panel 110 according to the internal image signals from the image processor 151. In addition, the logic controller 152 includes a calculation unit (not shown) and a memory (not shown) for generating driving control signals for the auxiliary display driver 158. That is, the logic controller 152 calculates the driving control signals $S_A$, $S_Y$, and $S_X$ for the plasma display panel 110 into the signals for displaying image of the auxiliary display panel 190 using the calculation unit, and stores the driving control signals $S_A$, $S_Y$, and $S_X$ and/or the calculated driving control signals in the memory. In addition, the logic controller 152 outputs the calculated driving control signals to the auxiliary display driver 158.

The address driver 153 processes the address signal $S_A$ among the driving control signals $S_A$, $S_Y$, and $S_X$ to generate a display data signal, and applies the display data signal to the address electrodes 132. The X driver 154 processes the X driving control signal $S_X$ among the driving control signals $S_A$, $S_Y$, and $S_X$ from the logic controller 152, and applies the processed signals to the X electrodes 123. The Y driver 155 processes the Y driving control signal $S_Y$ among the driving control signals $S_A$, $S_Y$, and $S_X$ from the logic controller 152, and applies the processed signal to the Y electrodes 124.

The auxiliary display driver 158 receives the driving signals output from the logic controller 152 and drives the red, green, and blue LEDs 194.

In addition, the power supplier 156 generates and supplies operational voltages required by the image processor 151 and the logic controller 152, and operational voltages required by the address driver 153, the X driver 154, the Y driver 155, and the auxiliary display driver 158.

The circuit unit 150 transmits electrical signals to the plasma display panel 110 via signal transmission units. The signal transmission units can be selected from Flexible Printed Cable (Fpc), Tape Carrier Package (TCP), and Chip on Film (COF). According to the present embodiment, FPCs 160 are disposed on left and right sides of the chassis 140 as the signal transmission units, and TCPs 170, each of which is formed by mounting at least one electronic device on a tape wiring unit, are disposed on upper and lower portions of the chassis 140 as the signal transmission units. In addition, referring to FIG. 1, the TCPs 170 are spaced apart from each other on upper and lower sides of the chassis 140.

Referring to FIG. 3, images displayed by the plasma display panel 110 and the auxiliary display member 190 are described in detail as follows.

As described above, the plasma display panel 110 displays the image using the gas discharge, and the plurality of pixels arranged in the display area 113 realize the image according to the signals of the logic controller 152. In addition, the auxiliary display member 190 surrounding the display area 113 of the plasma display panel 110 displays the image realized by the pixels disposed on the edge of the plasma display panel 110.

That is, the plurality of pixels are arranged along the edge of the display area 113 of the plasma display panel 110. The pixels P11, P12, . . . , P1n, P2n, . . . , Pmn, . . . Pm(n−1), . . . , Pm1, . . . , P21 are arranged from the upper left portion of the display area 113 in a clockwise direction. Each of the pixels includes the red, green, and blue sub-pixels.

In addition, as described above, the first pixel Q1, the second pixel Q2, . . . , the Lth pixel QL of the auxiliary display member 190 are disposed along the edge of the display area 113. In the present embodiment, the unit pixel of the auxiliary display member 190 corresponds to three pixels of the plasma display panel 10, and preferably, is disposed to correspond to adjacent pixels of the plasma display panel 110. Referring to FIG. 3, the first pixel Q1 of the auxiliary display member 190 corresponds to the pixels P11, P12, and P13 of the plasma display panel 110. The pixels of the auxiliary display member 190 arranged on left and right edges and lower edge of the display area 113 also correspond to the pixels of the plasma display panel 110 in one-to-three correspondences.

The pixels of the plasma display panel 110 and the corresponding pixel of the auxiliary display member 190 relate to each other to display image. For example, the unit pixel of the auxiliary display member 190 displays the image having an average color and an average saturation of the relating three pixels of the plasma display panel 110. Therefore, the auxiliary display member 190 can display the image similar to that of the pixels disposed on the edges of the plasma display panel 10. According to the present embodiment, three pixels of the plasma display panel 110 correspond to one pixel of the auxiliary display member 190. However, the present invention is not limited thereto.

As described above, when the image of the plasma display panel 110 is supported by the auxiliary display member 190, the user can see the extended image displayed by the auxiliary display member 190, as well as the image displayed on the display area 113 of the plasma display panel 110, and thus, the user can feel that he/she is viewing a larger screen. In particular, since the viewing angle of human being is concentrated on the center of the screen, less information can be displayed on the edge of the screen. Therefore, when the color, not detailed information of the image, is displayed on the outer portion of the screen, the user can see the clear image of high quality, and at the same time, can think that he/she sees the screen larger than it really is. In addition, according to the present embodiment, the auxiliary display member 190 displays the image using the LEDs. However, small bulbs or fluorescent lamps can be used to display the auxiliary image.

According to the present invention, the image area of the plasma display panel can be expanded by the auxiliary display member. Therefore, the user can think that he/she sees the screen larger than it really is.

While the present invention has been particularly shown and described with reference to exemplary embodiments thereof, it will be understood by those of ordinary skill in the art that various modifications in form and detail can be made therein without departing from the spirit and scope of the present invention as defined by the following claims.

What is claimed is:

1. A plasma display apparatus, comprising:

a plasma display panel including a display area having a plurality of pixels adapted to display an image; and an auxiliary display member having a plurality of unit pixels that are fewer in number than said plurality of pixels of said display area and surround the display area of the plasma display panel, wherein a number of said plurality of -pixels of said display area is a whole number multiple of a number of said plurality of pixels of said auxiliary display area.

2. The apparatus of claim 1, wherein the auxiliary display member is adapted to display an image using a plurality of Light Emitting Diodes (LEDs).

3. The apparatus of claim 1, wherein the N number of plurality of pixels of the plasma display panel is three (3) and the M number of the plurality of unit pixels of the auxiliary display member is one (1).

4. A plasma display apparatus, comprising:

a plasma display panel including a display area having a plurality of pixels adapted to display an image;

an auxiliary display member having a plurality of unit pixels that are fewer in number than said plurality of pixels of said display area and surround the display area of the plasma display panel; and a chassis including a front surface attached to the plasma display panel and a rear surface including a circuit unit having circuits adapted to drive the plasma display panel contained therein, wherein a number of said plurality of pixels of said display area is a whole number multiple of a number of said plurality of pixels of said auxiliary display area.

5. The apparatus of claim 4, further comprising:

a front case including a window adapted to enable the image displayed on the display area to be viewed; and a rear case attached to the front case to define an inner space containing the plasma display panel.

6. The apparatus of claim 5, wherein the auxiliary display member is disposed between the front case and the plasma display panel.

7. The apparatus of claim 6, wherein a portion of the front case corresponding to the auxiliary display member comprises a translucent material.

8. The apparatus of claim 5, wherein the auxiliary display member is adapted to display an image using a plurality of Light Emitting Diodes (LEDs).

9. The apparatus of claim 4, wherein the plurality of pixels of the plasma display panel is three (3) times the number of the plurality of unit pixels of the auxiliary display member.

* * * * *